United States Patent [19]

Eklund et al.

[11] Patent Number: 4,945,855

[45] Date of Patent: Aug. 7, 1990

[54] COATER

[75] Inventors: Dan Eklund, Kauniainen; Sivert Westergard, Järvenpää, both of Finland

[73] Assignee: Valmet Paper Machinery Inc., Helsinki, Finland

[21] Appl. No.: 261,500

[22] Filed: Oct. 24, 1988

Related U.S. Application Data

[60] Division of Ser. No. 917,256, Oct. 8, 1986, Pat. No. 4,791,879, which is a continuation of Ser. No. 729,467, May 1, 1985, abandoned.

[30] Foreign Application Priority Data

May 11, 1984 [FI] Finland ..... 841899

[51] Int. Cl.[5] ..... B05D 3/12; B05C 3/12

[52] U.S. Cl. ..... 118/407; 118/410; 118/413

[58] Field of Search ..... 118/410, 407, 413

[56] References Cited

U.S. PATENT DOCUMENTS

| | | | |
|---|---|---|---|
| 4,250,211 | 2/1981 | Damrau | 118/410 |
| 4,327,662 | 5/1982 | Damrau | 118/410 |
| 4,369,731 | 1/1983 | Bamrau | 118/410 |
| 4,398,494 | 8/1983 | Alheid | 118/410 |
| 4,405,661 | 9/1983 | Alheid | 118/410 |
| 4,452,833 | 6/1984 | Holt | 118/410 |
| 4,503,804 | 3/1985 | Damrau | 118/410 |

*Primary Examiner*—Sam Silverberg

*Attorney, Agent, or Firm*—Dellett, Smith-Hill and Bedell

[57] ABSTRACT

A coater for coating a running paper or carboard web comprises a coating chamber having one side open against the web and means for filling the coating chamber with pressurized coating substance. The coating chamber is limited in the longitudinal direction of the web by a web entrance wall, and opposite thereof, a back wall in the form of a doctor member for forming a coating layer on the web. The distance between the walls is so short that, at normal web running speed, the web moves from the web entrance wall to the back wall in a time of at the most 0.3 s, preferably at the most 0.03 s. Coating substance is supplied by means of positive pressure to the coating chamber at a position close to the web entrance wall. Close to the web entrance wall the flow of coating substance in the coating chamber is divided into two branches, of which a first branch follows the web in its running direction towards the back wall and a second branch, which is considerably greater than the first branch, flows out from the coating chamber through a slot between the web entrance wall and the web.

23 Claims, 4 Drawing Sheets

COATER

CROSS-REFERENCE TO RELATED APPLICATIONS

Figure 1:
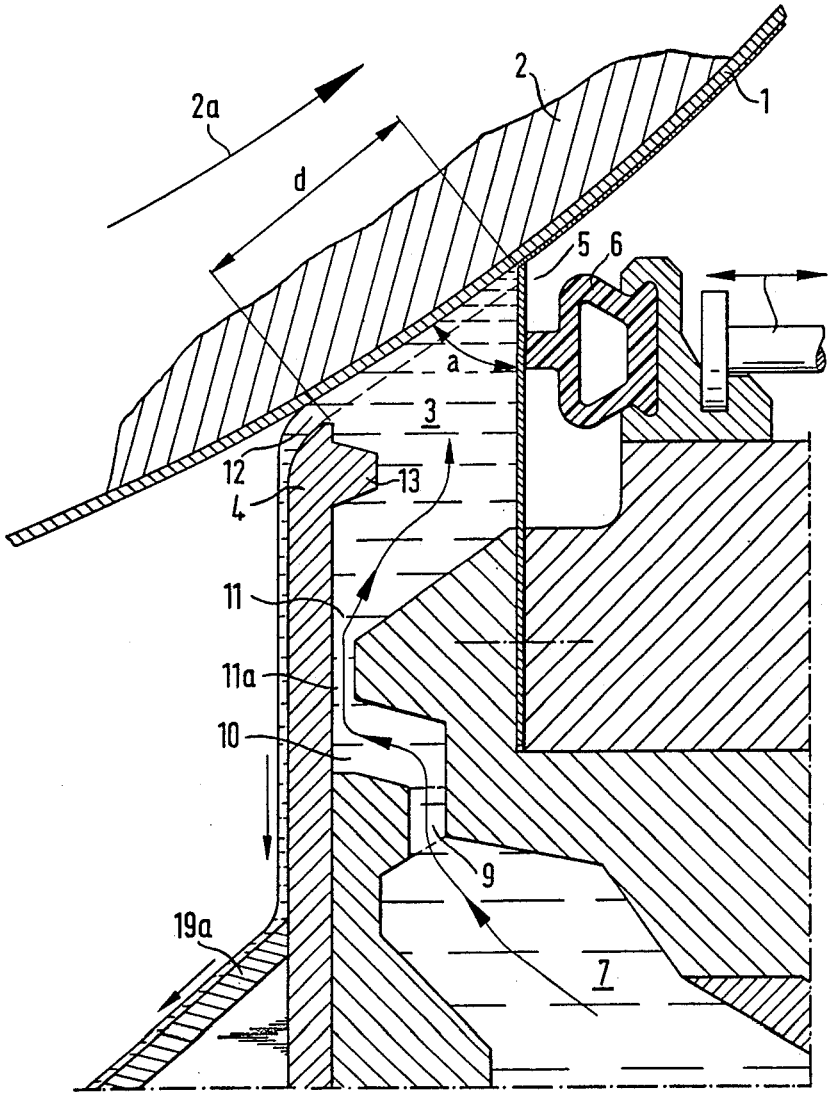

This is a division of copending patent application Ser. No. 06/917,256 filed Oct. 8, 1986, now U.S.Pat. No. 4,791,879, which is a continuation of copending application Ser. No. 06/729,467 filed May 1, 1985, abandoned.

BACKGROUND OF THE INVENTION

The invention relates to a coater for coating a running paper or cardboard web.

When coating a running paper or cardboard web with pigment coating, the quality of the coating is improved and the operation of the coater becomes easier, if the application of coating substance on the web and the forming of the coating layer are carried out very close to each other. Due to this, application of coating substance and the actual coating are nowadays usually carried out in the same device, for example, as described in U.S. Pat. No. 4250211. In devices of this kind, there is a problem with stationary vortices generated in the coating chamber of the applicator. Impurities occurring in the coating substance easily accumulate in the vortices, thus decreasing the purity of the coating substance in the coating chamber. At the same time the dry solids content of the coating substance in the coating chamber increases, because water is continuously absorbed by the running web. Due to the vortices the desired substituting of new coating substance for the old coating substance is not effective enough in the coating chamber. The phenomena described above have a deterioriating influence on the coater operation and on the coating quality.

An object of the invention is to avoid the drawbacks mentioned above and to provide a coater which gives a better coating quality and is easier to operate than known coaters. This is obtained by improving the flow pattern of the coating substance in the coating chamber. The features of the invention are stated in claim 1. By applying the invention it is possible to keep the coating substance in the coating chamber clean and homogeneous, because the flow in the chamber is so directed, that the coating substance in the chamber is continuously and efficiently replaced by new coating substance. The flow out from the coating chamber through the web entrance slot, that is, the slot through which web enters into the chamber, prevents air from entering into the chamber together with the web. In order to maintain this flow as steady and undisturbed as possible it is of advantage that the web entrance slot converges in the direction of movement of the web. For the same reason it is of advantage that the slot side facing the web joins the outside of the web entrance wall of the coating chamber in the form of a smooth continuous curve.

In order to be able to control the flow pattern in the coating chamber, the height of the web entrance slot between the web entrance wall of the coating chamber and the web should be made adjustable. This can be obtained, as known per se, by making the coating chamber wall movable or by making the entire coating chamber angularly adjustable relative to the web. In the latter case, adjustment will also change the angle of the doctor blade at the coating nip, which is not always desired. In order to maintain the angular position of the doctor blade unchanged, the blade and its holder may be connected to stationary portions of the coating chamber, whereas resilient members are arranged to allow small angular adjustments of the rest of the coating chamber.

In a preferred embodiment of the invention, the web entrance wall of the coating chamber comprises a protrusion extending towards the interior of the coating chamber. It has been found that a protrusion of this kind improves the flow pattern in the coating chamber.

In order to maintain the homogeneity of the coating substance, it is favourable that the flow speed varies in the inlet duct of the coating chamber. In this way continuous stirring of the coating substance is accomplished. Close before the coating chamber the inlet duct usually has a throttled passage, where the flow speed of the coating substance considerably increases. In order to insure the homogeneity of the coating substance, it is also favourable that the inlet duct makes at least one, preferably two abrupt direction changes. The increased flow speed and the abrupt direction changes accomplish that the coating substance supplied to the coating chamber is effectively homogenized.

In order to obtain a desired flow pattern in the coating chamber, it is favourable that the depth of the coating chamber measured perpendicularly to the web is about equal to or greater than the distance, in the web running direction, between the web entrance wall and the opposite wall, that is, the back wall of the coating chamber.

A coater according to the invention may be further improved by providing the coating chamber with a partition wall, which leads the flow of the coating substance entering the coating chamber first mainly along the web entrance wall of the coating chamber towards the web, thereafter in the web running direction, and finally along the back wall of the coating chamber away from the web. The partition wall may be so arranged, that the coating substance can freely flow around the partition wall, but it is also possible to provide the coating chamber with an outlet opening close to its back wall, that is, at the opposite side of the partition wall relative to the inlet opening of the coating chamber. The latter arrangement provides a possibility to control the flow in the coating chamber with great accuracy. The control may be improved by providing the outlet opening of the coating chamber with an adjustable flow throttling device.

With regard to flow control, it is also favourable that the position of the partition wall is adjustable, so that the height of the slot between the partition wall and the web can be varied. The adjustment range should preferably include slot heights of 0.1 to 5 mm. When a partition wall is used, the throttled passage of the inlet duct may be positioned in the coating chamber itself or a second throttled passage may be formed therein, in which the flow speed somewhat increases and possible pressure differences are equalized.

Because it is important to prevent air from entering the coating chamber together with the web, the adjustment of the partition wall must be made so, that the flow out through the web entrance slot remains sufficiently strong. This can be obtained by keeping the slot between the partition wall and the web narrower than the slot between the web entrance wall of the coating chamber and the web.

Even if the outlet opening of the coating chamber is located at the opposite side of the partition wall than the inlet opening, it might be useful to arrange, in the partition wall, a pressure equalizing opening, which preferably is located at a distance from the web greater than the distance between the web entrance wall and the back wall of the coating chamber measured along the web. Such an opening increases the possibilities to control the flow in the coating chamber.

A still more effective control of the flow in the coating chamber may be obtained by arranging a wall outside the web entrance wall of the coating chamber, thereby forming a substantially closed outlet duct for the coating substance flowing out through the web entrance slot of the coating chamber. In this duct a preferably controllable partial vacuum may be maintained, in order to further improve the flow control.

Especially at high web speeds it is important, that the web is firmly supported at the position of the coating chamber. For this purpose a conventional rotating support drum may be used, the peripheral speed and rotation direction of which follows the web movement. The support element also gives the advantage that, in the event of web rupture, only limited splashing of coating substance occurs.

Figure 2:
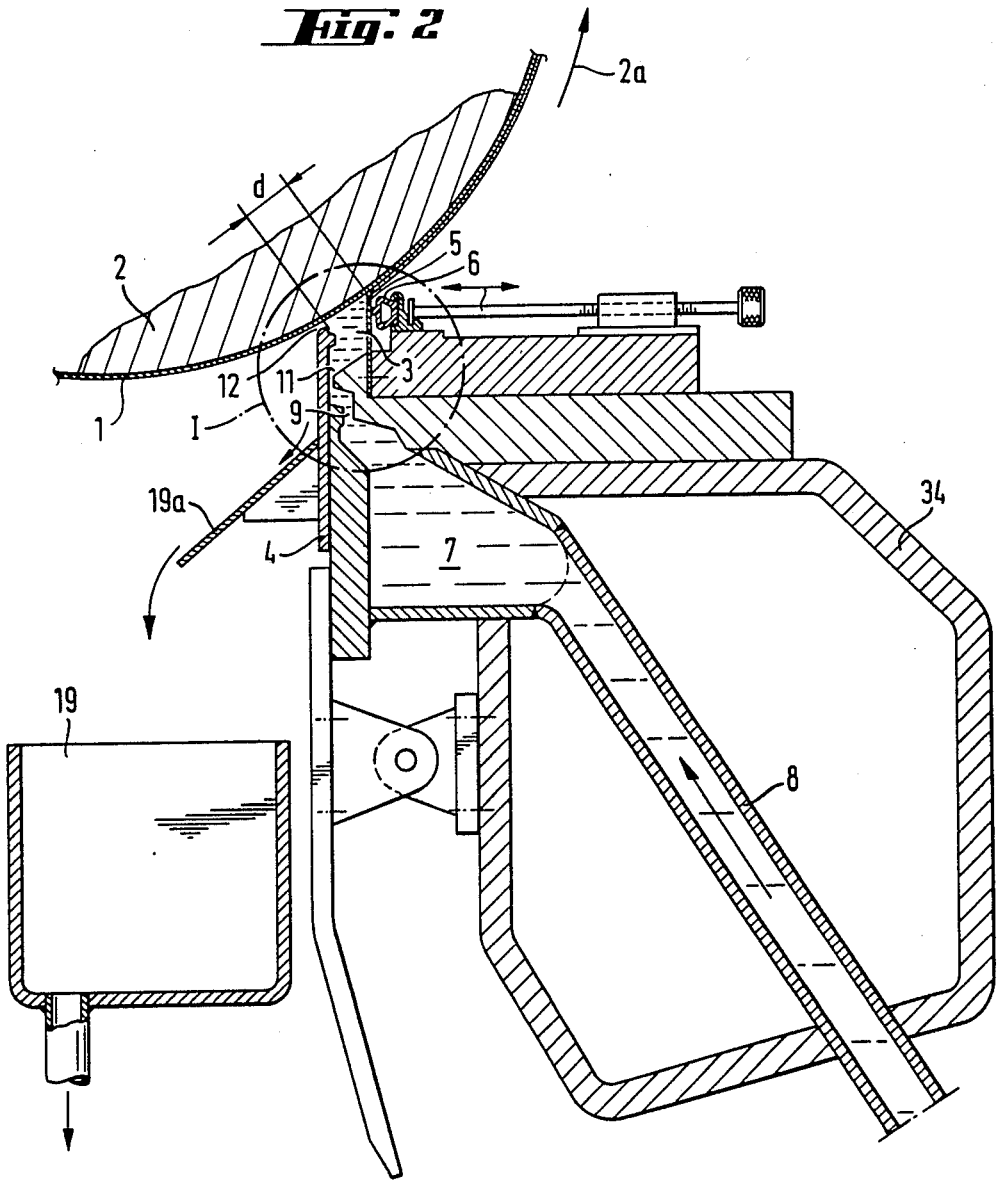
Figure 3:
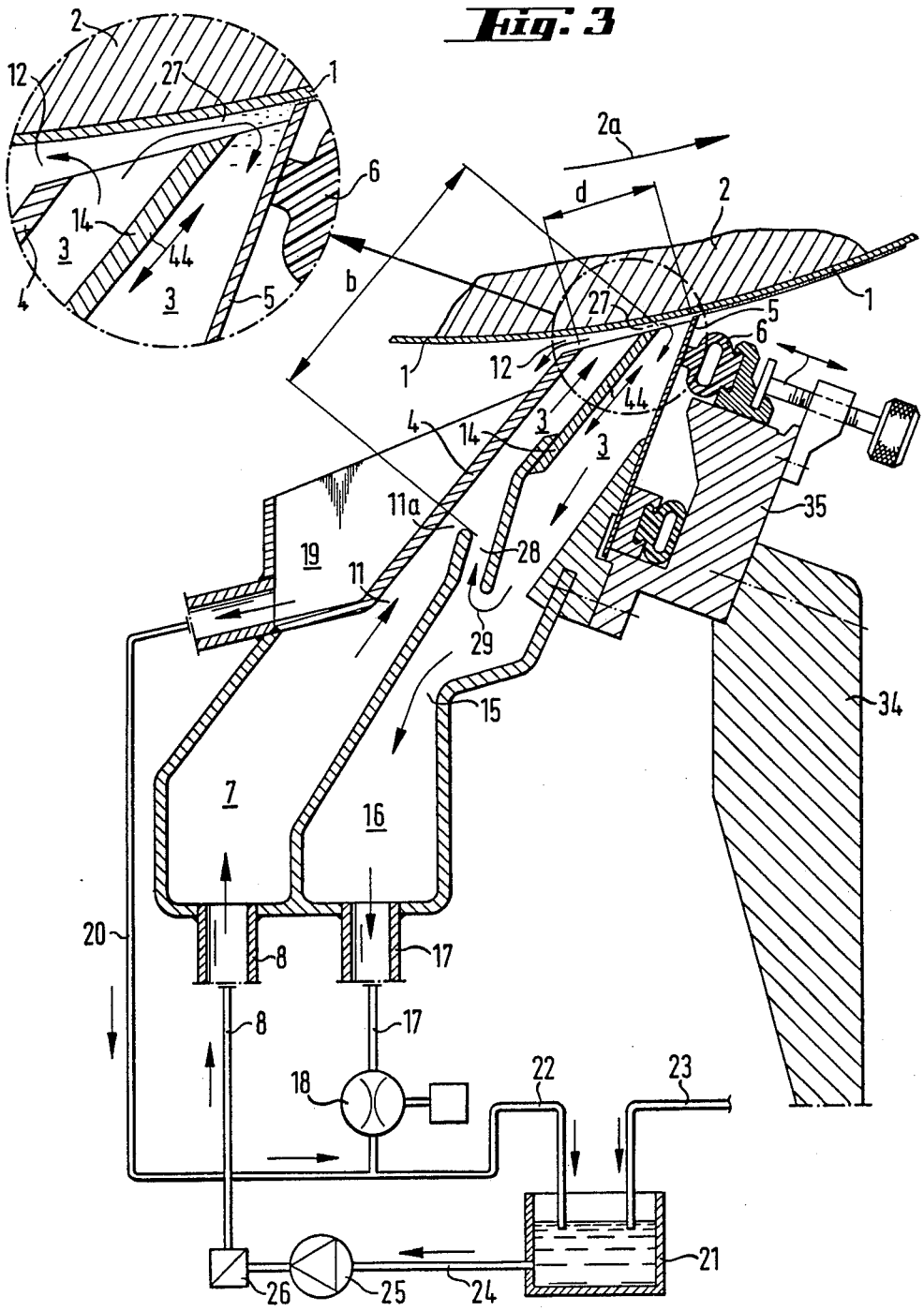
Figure 4:
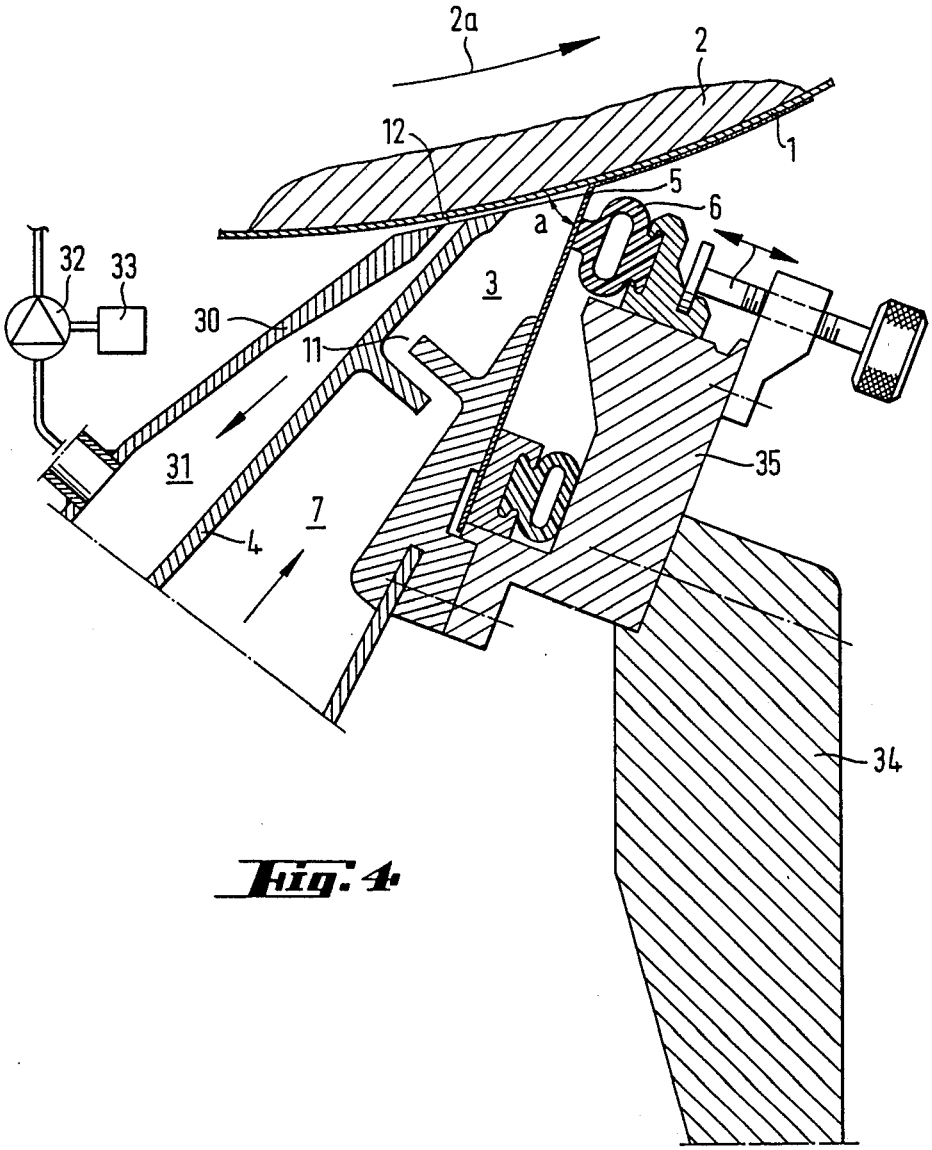

The invention will now be described, by way of example, with reference to the accompanying drawing, in which FIG. 1 schematically shows a section in the web running direction of a coater according to the invention, FIG. 2 shows, on a smaller scale, the general arrangement of a coater according to FIG. 1, FIG. 3 shows a sectional view, corresponding to the one of FIGS. 1 and 2, of a second embodiment of the invention, FIG. 4 shows a sectional view, corresponding to the one of FIGS. 1 and 2, of a third embodiment of the invention.

In the drawing, numeral 1 refers to a running paper or cardboard web and 2 to a support drum carrying the web. An arrow 2*a* refers to the moving direction of the drum 2. There is a coating chamber 3 having a web entrance wall 4 and a back wall 5. The back wall is formed by a flexible doctor blade, which forms an angle a with the web 1 and which is pressed against the web by a controllable force, acting over one or several pneumatic control elements 6 of rubber. The doctor blade pressure is controllable mechanically by screw means shown only schematically and also pneumatically by varying the pressure inside the element 6, thereby obtaining fine adjustment of the blade pressure. Instead of the doctor blade 5, a doctor rod arrangement may be used as well, for instance, generally of the kind shown in U.S. Pat. No. 3245377.

Below the coating chamber 3 there is a pressure equalizing chamber 7, to which coating substance is supplied through a duct 8. From the chamber 7 the coating substance flows via a throttled passage 9 to another smaller pressure equalizing chamber 10, from which it flows via an inlet duct 11 into the coating chamber 3. The inlet duct 11 is in the vicinity of the web entrance wall 4 of the coating chamber. The throttling and flow direction alteration passages 9,10,11*a* of the inlet duct provide an effective stirring of the coating substance, so that it remains as homogeneous as possible.

The pressure in the coating chamber 3 is usually kept at a level of 2 to 12 kPa above atmospheric pressure. Due to this pressure, a portion of the coating substance flows out from the coating chamber through a slot 12 between the web entrance wall 4 and the web 1. This flow prevents air from entering the coating chamber together with the running web 1. The web passes the distance d between the web entrance wall 4 and the back wall 5 of the coating chamber in a time which should be at the most 0.3 s, preferably at the most 0.03 s. Cardboard webs are usually coated at substantially lower speeds than paper webs. A typical paper coating speed is about 1000 m/min, which speed may be doubled or reduced by 50% or even more depending on the circumstances. During the passage of the web over the coating chamber a portion of the coating substance adheres to the web and is levelled and smoothed out in a coating nip between the edge of the doctor blade 5 and the web. A protrusion 13 at the inside of the web entrance wall 4 leads the coating substance flow in the coating chamber, so that stationary vortices are generally avoided. The extension of the protrusion 13 from the inner surface of the wall 4 towards the interior of the coating chamber is 5 to 15 mm, the distance d is 20 to 30 mm, and the angle a is usually between 30° and 60°. The depth of the coating chamber measured perpendicularly to the web 1 is about equal to the distance d. The diameter of the support drum 2 may be about 1 m.

FIG. 1 shows how, in the web entrance slot 12, the side surface facing the web forms a continous curve joining the outer surface of the wall element 4.

The embodiment shown in FIG. 3 differs from the embodiment shown in FIGS. 1 and 2 in that the depth of the coating chamber in a direction away from the web is greater, and, in addition, a partition wall 14 is provided in the middle of the coating chamber. As in the embodiment according to FIG. 1, coating substance is fed through pipes 8 to a pressure equalizing chamber 7, wherefrom it flows through an inlet duct 11 into the coating chamber 3. The coating chamber has an outlet duct 15 having downstream of the coating chamber an enlargement 16 and thereafter continuing in the form of several parallel pipes 17. These pipes are provided with an adjustable throttle valve 18, by means of which the pressure in the outlet duct 15 can be adjusted.

Coating substance flowing through the web entrance slot 12 is collected in a space 19, from where it flows away through a pipe 20 to a coating substance container 21, either directly or as shown by joining a pipe 22, to which also the coating chamber outlet pipes 17 are connected. Additional coating substance is continuously supplied to the coating substance container 21 through a pipe 23 to insure that a sufficient amount of coating substance is always available. Coating substance is pumped from the container 21 to the coating chamber 3 through a pipe 24 by means of a pump 25 and through a filter 26 and the pipes 8 connected to the pressure equalizing chamber 7.

The partition wall 14 of the coating chamber is preferably made adjustable relative to the web. Adjustment means are indicated by arrows 44. The position of the partition wall is so adjusted, that there is a slot 27 between the edge of the partition wall and the web, which slot is smaller than the web entrance slot 12. The height of the slot 27 is adjustable within a range of 0.1 to 5 mm.

There is a pressure equalizing opening 28 in the partition wall 14. This opening interconnects the two portions of the coating chamber that are at opposite sides of the partition wall. Measured along the partition wall, the opening 28 is at a distance b from the web 1. This distance is greater than the distance d between the opposite walls of the coating chamber in the web running direction. A portion of coating substance in the chamber 3 can return through the opening 28 to the inlet side of the coating chamber, as indicated by an arrow 29. This flow is increased if there is a throttled passage 11*a* in the inlet duct 11 close in front of the opening 28. The cross section area of the opening 28 may be adjusted within the limits of the partition wall position adjustment 44. It is also possible to use separate adjustment means for varying the size of the opening 28 independently of the adjustment of the slot 27.

In the embodiment shown in FIG. 4, a wall 30 is located outside the web entrance wall 4 of the coating chamber 3. This wall forms together with the web entrance wall 4 a flow duct 31 for the coating substance flowing out through the web entrance slot 12. The flow in the flow duct 31 may be increased by providing partial vacuum in the duct and the flow may be influenced by adjusting this vacuum. In this way an additional possibility to influence the flow pattern in the coating chamber is provided. The device for providing a partial vacuum in the duct 31 is shown as a vacuum pump 32 with control means 33.

Numeral 34 refers to the basic support member of the coating device and 35 to a conventional doctor blade 5 support beam. Normally, about 2 to 5 liter per second coating substance is fed to the coating chamber 3 for each meter of tranverse width of the web 1. This means that a 5 m wide web requires a of flow of about 10 to 25 l/s. The flow out through the web entrance slot 12 is usually at least 20 times the flow out through the coating nip.

The invention is not limited to the embodiment shown, but several modifications thereof are feasible within the scope of the attached claims. For example, means corresponding to the flow direction alternation and throttling arrangements 9,10,11*a* shown in FIG. 1 may be arranged between the chamber 7 and the chamber 3 shown in FIG. 3.

I claim:

1. A coater for coating a running paper or cardboard web, comprising:

wall means defining a coating chamber having an inlet end and an opposite outlet end, the chamber having an inlet opening at its inlet end for introducing coating substance into the chamber and being open against the web at its outlet end, the wall means including a web entrance wall that bounds the chamber in the upstream direction with respect to the path of movement of the web and is spaced from the web so as to define a slot for the web to enter the chamber, and a back wall structure that bounds the chamber in the opposite, downstream direction, said back wall structure including a doctor member that engages the web for forming a coating layer on the web, the distance between the web entrance wall and the doctor member at the outlet end of the chamber being such that, at normal web running speed, the web moves from the entrance wall to the doctor member in a time of at most 0.3 s, and the inlet opening being closer to the web entrance wall than to the back wall structure, whereby the flow of coating substance introduced into the coating chamber by way of the inlet opening is, at a position close to the web entrance wall, divided into two branches, of which a first branch follows the web in its running direction toward the back wall structure and a second branch, which is of a considerably greater volume flow rate than the first branch, flows out from the coating chamber through the slot, a partition wall located in said coating chamber between the web entrance wall and the back wall structure and spaced from the web, said partition wall defining passageways for the coating substance in said chamber, thereby leading the flow in said chamber, firstly, mainly along said web entrance wall, thereafter in the direction of the movement of the web, and thereafter along said back wall structure of the coating chamber away from the web, there being a throttled passage in the flow path of the coating substance at the web entrance wall side of the partition wall, and there being a pressure equalizing opening in the partition wall connecting the region of the coating chamber that is between the back wall structure and the partition wall with the region of the coating chamber that is between the web entrance wall and the partition wall and is immediately downstream of the throttled passage, and supply means connected to the inlet opening of the coating chamber for delivering pressurized coating substance into the coating chamber, the slot defined between the web entrance wall and the web being sufficiently narrow to limit the flow of coating substance from the coating chamber and thereby maintain the coating substance in the coating chamber under pressure.

2. A coater according to claim 1, wherein the supply means include an inlet conduit that terminates at said inlet opening, said inlet conduit being oriented to introduce coating substance into the coating chamber in a direction substantially parallel to the web entrance wall.

3. A coater according to claim 1, wherein the distance between the web entrance wall and the back wall is such that, at normal web running speed, the web moves from the web entrance wall to the back wall in a time of at the most 0.03 s.

4. A coater according to claim 1, in which said slot between said web entrance wall and said web converges in the web running direction.

5. A coater according to claim 1, wherein the position of the partition wall is adjustable in a manner such as to influence the height of a slot between the partition wall and the web.

6. A coater according to claim 1, in which there is a wider slot between the web entrance wall and the web than between the partition wall and the web.

7. A coater according to claim 1, in which said coating chamber has an outlet opening adjacent to the back wall of the chamber.

8. A coater according to claim 7, in which a duct is connected to said outlet opening, said duct comprising a passage with adjustable throttling means.

9. A coater according to claim 1, in which there is, outside the coating chamber in front of the web entrance wall, a wall forming together with the web entrance wall a flow duct for coating substance flowing out through the slot between the web entrance wall and the web.

10. A coater according to claim 9, comprising means for maintaining a partial vacuum in the flow duct outside the web entrance wall of the coating chamber.

11. A coater for coating a running paper or cardboard web, comprising:

wall means defining a coating chamber having an inlet end and an opposite outlet end, the chamber having an inlet opening at its inlet end for introducing coating substance into the chamber and being open against the web at its outlet end, the wall means including a web entrance wall that bounds the chamber in the upstream direction with respect to the path of movement of the web and its spaced from the web so as to define a slot for the web to enter the chamber, and a back wall structure that bounds the chamber in the opposite, downstream direction, said back wall structure including a doctor member that engages the web for forming a coating layer on the web, the distance between the web entrance wall and the doctor member at the outlet end of the chamber being such that, at normal web running speed, the web moves from the entrance wall to the doctor member in a time of at most 0.3 s, and the inlet opening being closer to the web entrance wall than to the back wall structure, whereby the flow of coating substance introduced into the coating chamber by way of the inlet opening is, at a position close to the web entrance wall, divided into two branches, of which a first branch follows the web in its running direction toward the back wall structure and a second branch, which is of a considerably greater volume flow rate than the first branch, flows out from the coating chamber through the slot, a partition wall located in said coating chamber between the web entrance wall and the back wall structure and spaced from the web, said partition wall defining passageways for the coating substance in said chamber, thereby leading the flow in said chamber, firstly, mainly along said web entrance wall, thereafter in the direction of the movement of the web, and thereafter along said back wall structure of the coating chamber away from the web, there being a pressure equalizing opening in the partition wall connecting the region of the coating chamber that is between the back wall structure and the partition wall with the region of the coating chamber that is between the web entrance wall and the partition wall, and supply means connected to the inlet opening of the coating chamber for delivering pressurized coating substance into the coating chamber, the slot defined between the web entrance wall and the web being sufficiently narrow to limit the flow of coating substance from the coating chamber and thereby maintain the coating substance in the coating chamber under pressure.

12. A coater according to claim 11, wherein the supply means include an inlet conduit that terminates at said inlet opening, said inlet conduit being oriented to introduce coating substance into the coating chamber in a direction substantially parallel to the web entrance wall.

13. A coater according to claim 11, wherein the position of the partition wall is adjustable in a manner such as to influence the height of a slot between the partition wall and the web.

14. A coater according to claim 11, in which there is a wider slot between the web entrance wall and the web than between the partition wall and the web.

15. A coater according to claim 11, in which said coating chamber has an outlet opening adjacent to the back wall of the chamber.

16. A coater according to claim 15, in which a duct is connected to said outlet opening, said duct comprising a passage with adjustable throttling means.

17. A coater for coating a running paper or cardboard web, comprising:

wall means defining a coating chamber having an inlet end and an opposite outlet end, the chamber having an inlet opening at its inlet end for introducing coating substance into the chamber and being open against the web at its outlet end, the wall means including a web entrance wall that bounds the chamber in the upstream direction with respect to the path of movement of the web and is spaced from the web so as to define a slot for the web to enter the chamber, and a back wall structure that bounds the chamber in the opposite, downstream direction, said back wall structure including a doctor member that engages the web for forming a coating layer on the web, the distance between the web entrance wall and the doctor member at the outlet end of the chamber being such that, at normal web running speed, the web moves from the entrance wall to the doctor member in a time of at most 0.3 s, a partition wall located in said coating chamber between the web entrance wall and the back wall structure and spaced from the web, said partition wall dividing the coating chamber into a first region between the web entrance wall and the partition wall and a second region between the partition wall and the back wall structure, and there being a pressure equalizing opening in the partition wall connecting the first and second regions of the coating chamber, the inlet opening being between the web entrance wall and the partition wall so that coating substance introduced into the coating chamber by way of the inlet opening flows firstly mainly along said web entrance wall, and the flow is divided at a position close to the web entrance wall into a first branch, which follows the web in its direction towards the back wall structure and thereafter flows away from the web along the back wall structure, and a second branch, which is of a considerably greater volume flow rate than the first branch and flows out from the coating chamber through the slot.

18. A coater according to claim 17, wherein the supply means include an inlet conduit that terminates at said inlet opening, said inlet conduit being oriented to introduce coating substance into the coating chamber in a direction substantially parallel to the web entrance wall.

19. A coater according to claim 17, wherein the position of the partition wall is adjustable in a manner such as to influence the height of a slot between the partition wall and the web.

20. A coater according to claim 17, in which there is a wider slot between the web entrance wall and the web than between the partition wall and the web.

21. A coater according to claim 17, in which said coating chamber has an outlet opening adjacent to the back wall of the chamber, and a duct is connected to said outlet opening, said duct comprising a passage with adjustable throttling means.

22. A coater according to claim 17, in which there is, outside the coating chamber in front of the web entrance wall, a wall forming together with the web entrance wall a flow duct for coating substance flowing out through the slot between the web entrance wall and the web.

23. A coater according to claim 17, in which there is a throttled passage in the flow path of the coating substance at the web entrance wall side of said partition wall, said throttled passage being immediately upstream of the pressure equalizing opening with respect to the flow of coating substance along the web entrance wall.

* * * * *